US012691987B2

(12) United States Patent
Durand et al.

(10) Patent No.: US 12,691,987 B2
(45) Date of Patent: Jul. 28, 2026

(54) OFF-THROTTLE STEERING FOR JET PROPULSION WATERCRAFT

(71) Applicant: Taiga Motors Inc., Lasalle (CA)

(72) Inventors: Sean Durand, Brossard (CA); Cyrus Larsen, Vancouver (CA); Jean-Philippe Landry, Terrebonne (CA); Felix Collin, Montreal (CA)

(73) Assignee: Taiga Motors Inc., Lasalle (CA)

( * ) Notice: Subject to any disclaimer, the term of this patent is extended or adjusted under 35 U.S.C. 154(b) by 676 days.

(21) Appl. No.: 18/206,445

(22) Filed: Jun. 6, 2023

(65) Prior Publication Data

US 2023/0415878 A1 Dec. 28, 2023

Related U.S. Application Data

(60) Provisional application No. 63/353,269, filed on Jun. 17, 2022.

(51) Int. Cl.

| | |
|---|---|
| ***B63H 25/46*** | (2006.01) |
| ***B63B 34/10*** | (2020.01) |
| ***B63H 21/17*** | (2006.01) |

(52) U.S. Cl.

CPC ..... *B63H 25/46* (2013.01); *B63B 34/10* (2020.02); *B63H 21/17* (2013.01)

(58) Field of Classification Search

CPC ..... B63H 25/46; B63H 21/17; B63B 34/10

See application file for complete search history.

(56) References Cited

U.S. PATENT DOCUMENTS 6,231,410 B1 * 5/2001 Bernier ..... B63H 21/213 440/40
6,336,833 B1 * 1/2002 Rheault ..... B63H 21/21 114/144 R (Continued)

FOREIGN PATENT DOCUMENTS

CA 3156091 A1 * 7/2022 ..... B63H 21/17
CA 3209020 A1 * 2/2024 ..... B63H 21/21

(Continued)

OTHER PUBLICATIONS

Paul Kamen, et al., "Personal Watercraft Steering, Braking and Testing", Surface Propulsion Analysis. 36 pgs. Mar. 2010.

(Continued)

*Primary Examiner* — Marc Q Jimenez
*Assistant Examiner* — Jovon E Hayes
(74) *Attorney, Agent, or Firm* — Dicke, Billig & Czaja, PLLC

(57) ABSTRACT

One example provides an electric watercraft including a jet propulsion system to form a water jet to provide thrust to propel the watercraft, an electric motor to drive the jet propulsion system, a battery system to power the motor, an accelerator which can be actuated over an accelerator actuation range to control the motor to adjust an amount of thrust provided by the water jet, and a steering mechanism operable over a steering range to steer the watercraft. A controller receives information indicative of a speed of the watercraft and enables an otherwise disabled off-throttle steering functionality when the speed exceeds a predetermined speed threshold. When the off-throttle steering functionality is enabled, the controller activates the off-throttle steering functionality in response to off-throttle steering conditions being satisfied, and when the off-throttle steering functionality is disabled, prevents activation of the off-throttle steer- (Continued)

ing functionality when the off-throttle steering conditions are satisfied.

22 Claims, 6 Drawing Sheets

(56) References Cited

U.S. PATENT DOCUMENTS

| | | | | |
|---|---|---|---|---|
| 6,405,669 | B2 * | 6/2002 | Rheault | F02D 11/02 114/144 R |
| 6,415,729 | B1 * | 7/2002 | Nedderman, Jr. | B63H 25/382 114/144 R |
| 6,827,031 | B2 * | 12/2004 | Aoyama | B63H 25/44 114/284 |
| 7,315,779 | B1 * | 1/2008 | Rioux | F02D 31/006 123/352 |
| 9,517,826 | B1 * | 12/2016 | Leblond | B63H 11/113 |
| 11,603,172 | B1 * | 3/2023 | Duffy-Protentis | B63B 45/04 |
| 12,466,532 | B1 * | 11/2025 | Kirchhoff | B60L 15/40 |
| 2003/0000443 | A1 * | 1/2003 | Bernier | B63H 21/22 114/151 |
| 2013/0344754 | A1 * | 12/2013 | Kinoshita, I | F02D 41/021 440/1 |
| 2016/0039504 | A1 * | 2/2016 | Okamoto | B63H 11/04 415/35 |
| 2022/0332398 | A1 * | 10/2022 | Bernatchez | B63H 21/21 |
| 2022/0363136 | A1 * | 11/2022 | Bruneau | H02P 3/00 |
| 2022/0363138 | A1 * | 11/2022 | Bruneau | B60L 3/0061 |
| 2023/0011707 | A1 * | 1/2023 | Achard | B63H 21/22 |
| 2023/0322349 | A1 * | 10/2023 | Roy-Bernier | B63H 21/17 440/38 |
| 2024/0132194 | A1 * | 4/2024 | Ikegaya | B63H 25/02 |
| 2024/0278893 | A1 * | 8/2024 | Araki | B63H 11/08 |
| 2024/0429527 | A1 * | 12/2024 | Bernier | B60L 50/66 |
| 2025/0206430 | A1 * | 6/2025 | Durand | B63B 34/10 |

FOREIGN PATENT DOCUMENTS

| | | | | |
|---|---|---|---|---|
| CA | 3221734 | A1 * | 6/2024 | B60L 58/16 |
| EP | 4501775 | A1 * | 2/2025 | B63H 21/21 |
| JP | 2002317673 | A * | 10/2002 | F02D 11/105 |

OTHER PUBLICATIONS

Edward W. Kamnes, et al. "PWC Off-Throttle Steering Hazards: Attempted Remedy; Failure; and then Success," Proceedings of the 20th Congress of the International Ergonomics Association, First Online: Aug. 5, 2018.

David R. Lenorovitz, Personal Watercraft (PWC) Injury Hazards—Anaylses, Technical Advancements, and continuing Safety Challenges, Published online Feb. 4, 2020.

Craig Good, "Personal Watercraft: High-Speed Fun, High-Speed Defects," 5 pgs, 2010.

Craig Good, "Off-Throttle Turning Performance of Personal Watercraft for Accident Reconstruction", Collision Analysis Ltd., SAE International 2005.

Craig Good, "Stopping Distance and Acceleration Performance of Personal Watercraft", Collision Analysis Ltd, SAE International 2005.

* cited by examiner

OFF-THROTTLE STEERING FOR JET PROPULSION WATERCRAFT

CROSS-REFERENCE TO RELATED APPLICATION(S)

This application claims priority from U.S. Provisional Patent Application No. 63/353,269, filed Jun. 17, 2022, which is incorporated by reference in its entirety herein.

TECHNICAL FIELD

The present disclosure relates generally to jet propulsion watercraft, including electric jet propulsion vehicles, and, more particularly, to examples of an off-throttle steering (OTS) system for jet propulsion watercraft.

BACKGROUND

Jet propulsion type watercraft, such as personal watercraft (PWC), are propelled using thrust provided by a jet of water discharged from a directionally controllable nozzle at a rear of the watercraft. The amount of thrust provided by the jet of water is adjusted via an operator controlled accelerator mechanism (e.g., a throttle or accelerator), with the direction of the nozzle being controlled via an operator controlled steering mechanism (e.g., a steering wheel or handlebars) to steer the watercraft. Such steering systems are sometimes referred to as controlled thrust steering systems.

SUMMARY

Examples of the present disclosure provide an off-throttle steering (OTS) system for a jet propulsion watercraft, including a personal watercraft (PWC).

One example provides an electric watercraft including a jet propulsion system to form a water jet to provide thrust to propel the watercraft, an electric motor to drive the jet propulsion system, a battery system to power the motor, an accelerator which can be actuated over an accelerator actuation range to control the motor to adjust an amount of thrust provided by the water jet, and a steering mechanism operable over a steering range to steer the watercraft. A controller receives information indicative of a speed of the watercraft and enables an otherwise disabled off-throttle steering functionality when the speed exceeds a predetermined speed threshold. When the off-throttle steering functionality is enabled, the controller activates the off-throttle steering functionality in response to off-throttle steering conditions being satisfied, and when the off-throttle steering functionality is disabled, prevents activation of the off-throttle steering functionality when the off-throttle steering conditions are satisfied.

One example provides a watercraft including a jet propulsion system to form a water jet to provide thrust to propel the watercraft, a driver unit to drive the jet propulsion system, an accelerator which can actuated over an accelerator actuation range to control the driver to adjust an amount of thrust provided by the water jet, a steering mechanism operable over a steering range to steer the watercraft, and a first device to provide a first output having a value representing a first operating parameter which is indicative of a speed of the watercraft. A controller samples the value of the first output at a sampling rate, dynamically adjusts an energy accumulation value based on each sample value of the first output, wherein a present value of the energy accumulation value is representative of a speed of the watercraft, and enables off-throttle steering functionality of the watercraft when the energy accumulation value exceeds a threshold energy accumulation value, otherwise to disable off-throttle steering of the watercraft. In one example, a second device provides a second output having a value representing a second operating parameter which is indicative whether the watercraft is turning. When the off-throttle steering functionality is enabled, when the accelerator is operated at less than a position below an accelerator threshold position of the accelerator actuation range, and the second output value exceeds a threshold value of the second operating parameter, the controller activates off-throttle steering functionality by directing the motor to drive the jet propulsion system to provide an off-throttle steering thrust magnitude for an off-throttle steering thrust duration. In one example, the drive unit is an electric motor powered by a rechargeable battery system. In one example, the drive unit is an internal combustion engine.

One example provides a method of operating an electric jet propulsion watercraft including monitoring an operating speed of the watercraft and enabling an otherwise disabled off-throttle steering functionality when the operating speed of the watercraft exceeds a predetermined operating speed threshold. When the off-throttle steering functionality is enabled, the method includes activating the off-throttle steering functionality in response to off-throttle steering conditions being satisfied, and when the off-throttle steering functionality is disabled, the method includes preventing activation of the off-throttle steering functionality when the off-throttle steering conditions are satisfied. In one example, the method includes deeming the off-throttle steering conditions to be satisfied when an accelerator controlling an electric motor driving a jet propulsion system of the watercraft is in a non-actuated position, and a steering mechanism for steering the watercraft is at an operated position exceeding a steering angle threshold within a steering range of the steering mechanism. In one example, activating the off-throttle steering system includes commanding an electric motor to drive a jet propulsion system to provide an off-throttle steering thrust magnitude for an off-throttle steering thrust duration.

Additional and/or alternative features and aspects of examples of the present technology will become apparent from the following description and the accompanying drawings.

DETAILED DESCRIPTION

Figure 1A:
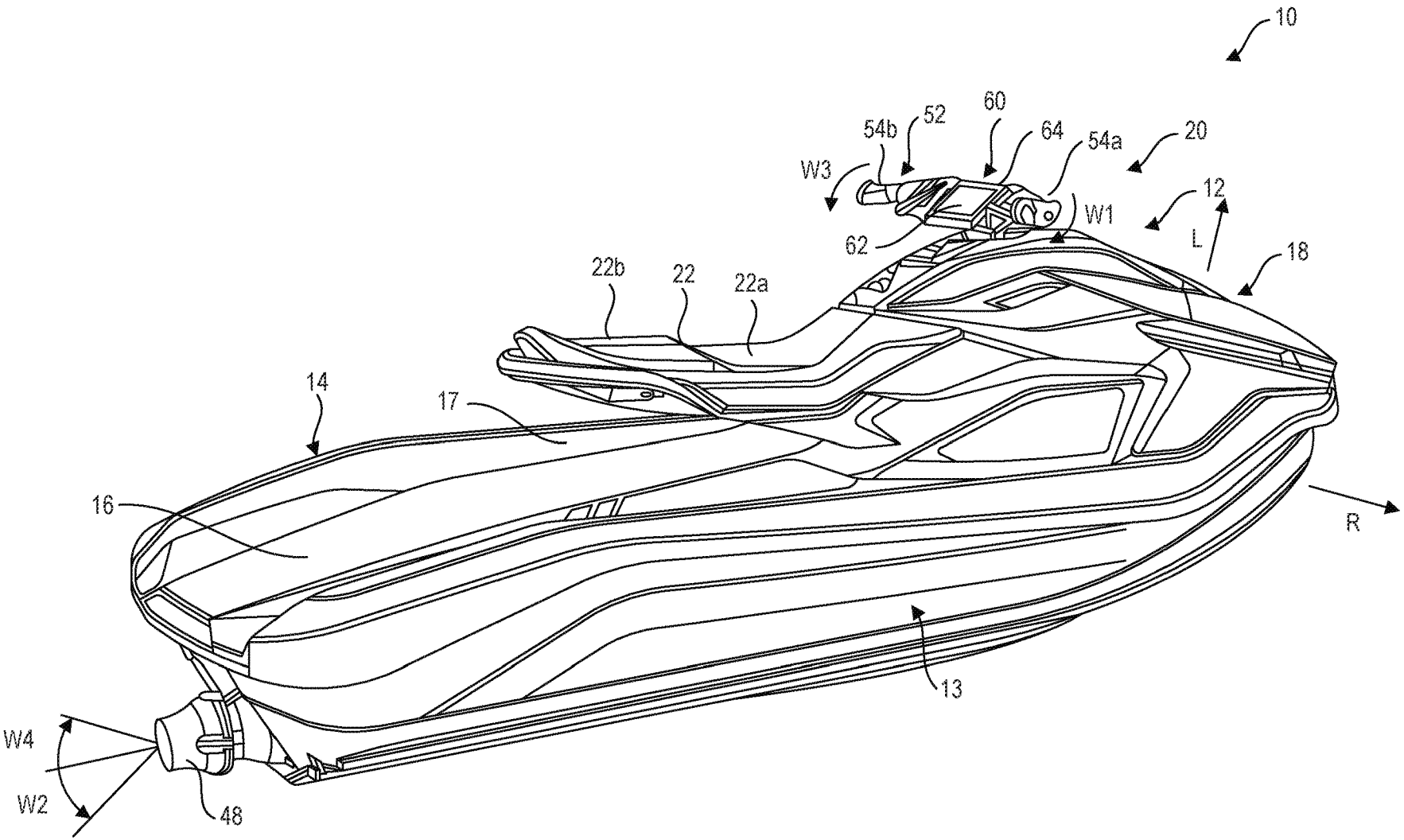
FIG. 1A is a perspective view generally illustrating a watercraft, in particular, a jet propulsion personal watercraft according to an embodiment of the present disclosure.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense. It is to be understood that features of the various examples described herein may be combined, in part or whole, with each other, unless specifically noted otherwise.

Electric powersport vehicles (EPVs), such as snowmobiles, personal watercraft (PWC), all-terrain vehicles (ATVs), and side-by-side vehicles (SSVs), for example, offer powersport enthusiasts a quiet, clean, and more environmentally friendly option to gas-powered vehicles. Electric vehicles have electric powertrains which typically include a battery system, one or more electrical motors, each with a corresponding electronic power inverter (sometimes referred to as a motor controller), and various ancillary systems (e.g., cooling systems).

Jet propulsion watercraft, including PWC, employ a jet propulsion system to create a pressurized jet of water which provides thrust to propel the watercraft through the water. The water jet is typically ejected from a rear of the watercraft through a pivoting steering nozzle, the direction of which is controllable via a user operated steering mechanism (e.g., handlebars or steering wheel) to control the direction of thrust and thereby steer the watercraft. Such a steering system is sometimes referred to as controlled thrust steering system. The jet propulsion system is driven by a driver unit, where such driver unit is an electric motor (or motors) powered by a battery system in electrical jet propulsion watercraft, and is a gas powered internal combustion engine in traditional jet propulsion watercraft.

During operation, the water jet generated by the jet propulsion system must provide an adequate amount of thrust to enable an operator to properly steer the watercraft. Typically, the amount of thrust provided by the water jet is controlled by a user operated accelerator mechanism which can be actuated over an actuation range (such as a throttle or accelerator, for example). In instances when evasive maneuvering of the watercraft may be required, such as when unexpectedly encountering an object in the water, an operator may quickly turn the steering mechanism to avoid the object. In some instances, when undertaking such evasive maneuvers, an operator, particularly an inexperienced operator, may instinctively release or "back off" on the accelerator (e.g. throttle) to slow the watercraft. However, if the accelerator is released too far, the water jet produced by the jet propulsion system may provide too little thrust to enable the watercraft to be effectively steered. For example, if the accelerator is released completely, all thrust will be lost and the operator will lose the ability to steer the watercraft. In such instances, even though an operator may be operating the steering mechanism in an attempt to turn the watercraft, the watercraft might not turn sharply enough, or fail to turn at all, such that the watercraft's momentum may potentially carry the watercraft into the object.

As will be described in greater detail herein, the present disclosure provides examples of an off-throttle steering (OTS) system for a jet propulsion watercraft, in particular, an electric jet propulsion watercraft, such as an electric PWC. According to examples, the OTS system monitors a number of OTS operating parameters, and when the monitored OTS operating parameters are indicative of the watercraft operating under OTS operating conditions, the OTS system controls the jet propulsion system to generate a water jet providing an amount of steering thrust to enable the watercraft to be effectively steered when the accelerator (e.g. throttle) is in a released position. In examples, as will be described in greater detail below, the accelerator is considered to be in a released position when fully released or released to a position which would otherwise result in the jet propulsion system providing an amount of thrust insufficient to adequately steer the watercraft.

In one example, the OTS system includes a controller and a first device providing a first output indicative of an operating speed of the PWC. In one example, the controller is to enable an otherwise disabled off-throttle steering functionality when the first output indicates a speed of the watercraft exceeds a predetermined speed threshold. When the off-throttle steering functionality is enabled, the controller is to activate the off-steering functionality in response to off-throttle steering conditions being satisfied, and when the off-throttle steering functionality is disabled, to prevent activation of the off-throttle steering functionality when the off-throttle steering conditions are satisfied. In one example, activating the off-throttle steering functionality includes the controller commanding the electric motor to drive the jet propulsion system to provide a steering thrust magnitude for a thrust duration. In one example, the controller deems the off-throttle steering conditions to be satisfied when the accelerator is in a released position, and when the steering mechanism is in an operated position within a steering range.

Figure 1B:
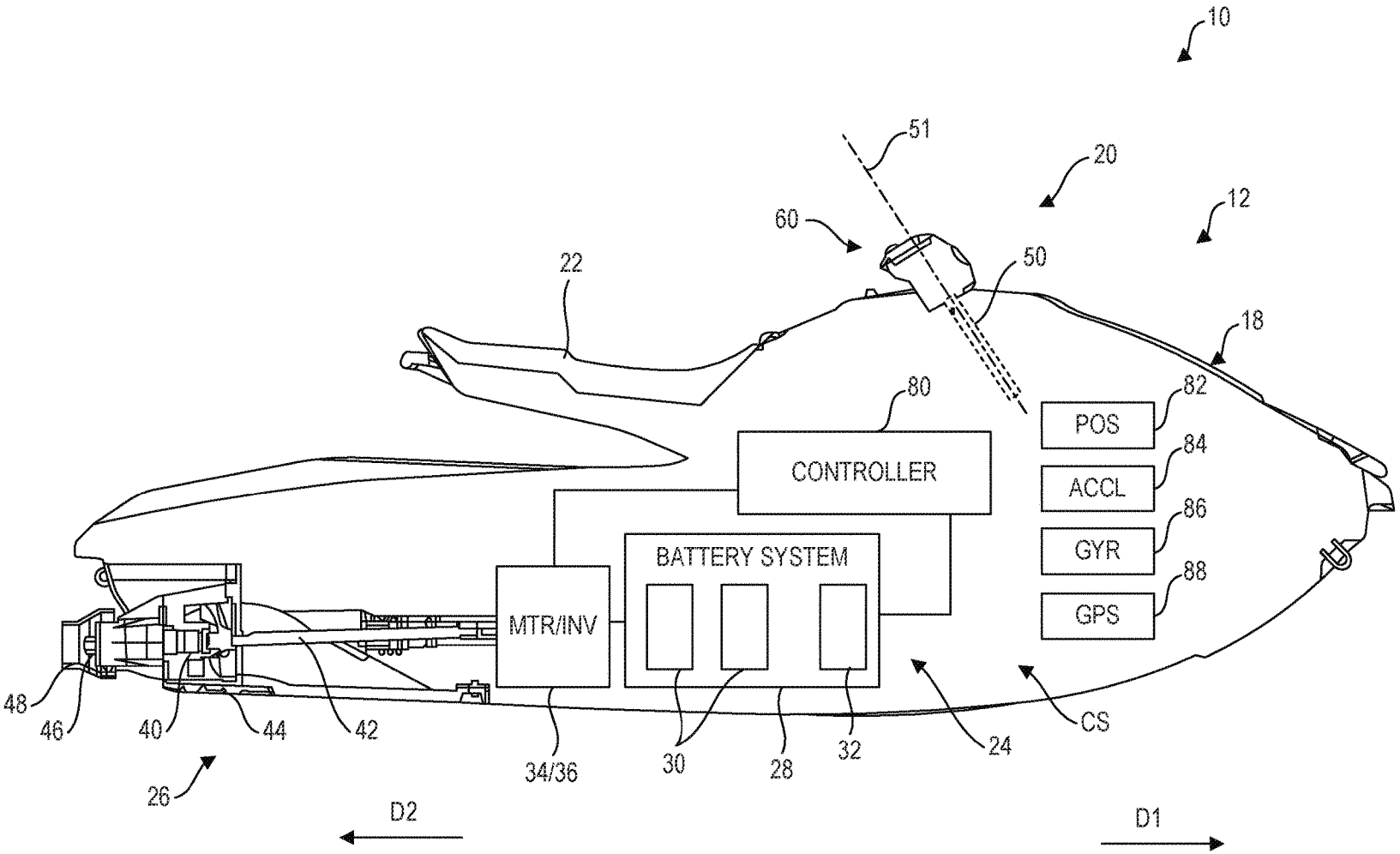
FIG. 1B is a side view generally illustrating the watercraft of FIG. 1A.

FIGS. 1A and 1B are perspective and side views generally illustrating a jet propulsion watercraft 10, in this case, an electric personal watercraft (PWC) 10, employing an OTS system 12, in accordance with examples of the present disclosure. Although illustrated and described with regard to electric PWC 10, it is noted that examples of an OTS system 12, as will be described in greater detail below, may be adapted for use with other types of jet propulsion watercraft, such as jet boats, for example, and with both electrically driven and internal combustion engine driven jet propulsion watercraft.

In examples, PWC 10 includes a hull 13 defining a lower portion of PWC 10 which is to be partially submerged in water to provide buoyancy, and a deck body 14 sealably secured to hull 13 and defining an upper portion of PWC 10. In examples, as illustrated, deck body 14 defines a rear platform 16 which enables users to board from the water via the rear of the watercraft. In examples, deck body 14 further defines opposing footwells 17, and a raised forward body 18 supporting a steering system 20. A straddle seat 22 is secured to deck body 14 and, in one example, extends in a rearward direction D2 (opposite a forward direction D1) from raised forward body 18 over rear platform 16 between footwells 17 (e.g., is cantilevered from forward body 18). In one example, straddle seat 22 defines operator and passenger seating positions 22*a* and 22*b*.

In examples, PWC 10 includes an electric powertrain 24 to drive a jet propulsion system 26, which generates a pressured jet of water to provide thrust to propel PWC 10 though the water. In examples, electric powertrain 24 includes a battery system 28 having a number of rechargeable battery modules 30 and a battery management system (BMS) 32, and an electric motor 34 driven by a corresponding electronic controller 36 (also sometimes referred to simply as an "inverter") powered by battery system 28. Electric motor 34 and electronic controller 36 are shown as integrated in a shared housing in FIG. 1B, however, in other embodiments, electric motor 34 and electronic controller 36 may be in separate housings and connected via cables. In examples, electronic controller (inverter) 36 converts DC power received from battery system 28 to AC power to drive electric motor 34. In examples, electric motor 34 may be a permanent magnet synchronous motor or a brushless direct current motor, for example. In examples, electric motor 34 has a power output of between 120 and 180 horsepower. In other examples, electric motor 34 has a maximum output power of greater than 180 horsepower. While illustrated and described in terms of a single motor/inverter pair 34/36, in other examples, electric PWC 10 may include multiple motor/inverter pairs 34/36.

In examples, rechargeable battery modules 30 each include a number of battery cells (not shown) which are interconnected with one another in parallel and/or series combinations to provide a high voltage (HV) DC output, such as in the range of 300-400 VDC, and in some cases up to 800 VDC, for example. In some examples, battery modules 30 include lithium ion or other battery cell types. In examples, BMS 32 monitors and regulates a number of operating parameters of battery system 28, such as voltage and temperature levels of battery modules 30 and/or individual battery cells thereof, for example.

In examples, jet propulsion system 26 includes an impeller 40 which is drivingly engaged with electric motor 34 via a drive shaft 42, where electric motor 34 is in a speed-transmitting or torque-transmitting engagement with drive shaft 42 (such as via direct connection from motor 34 to drive shaft 42, or via a gear drive or chain/sprocket interconnection, for example) such that torque produced by electric motor 34 drives impeller 40. When driven by electric motor 34, impeller 40 draws water through an intake 44 on an underside of hull 13 and forces the water through a venturi 46 which accelerates the water to provide additional thrust. The accelerated water is ejected from venturi 46 through a pivoting steering nozzle 48 which is controlled by an operator via steering assembly 20 to provide a directionally controllable jet of water to propel and steer PWC 10. In some examples, steering nozzle 48 may be directed upward and downward to provide trim control of PWC 10. In examples, a trim angle of steering nozzle 48 may be operator controlled, such as via inputs on control console 60 (see below).

In examples, steering assembly 20 (e.g. steering mechanism) includes a steering column 50 having a proximal end extending from raised forward body 18 at a position forward of seat 22, and a distal end disposed within an internal space of PWC 10 which is in operational communication with steering nozzle 48. Steering assembly 20 may further includes a handlebar assembly 52 coupled to the proximal end of steering column 50, with handlebar assembly 52 having opposing right- and left-hand grip ends 54*a* and 54*b*. In examples, handlebar assembly 52 and steering column 50 pivot together about a longitudinal axis 51 of steering column 50 to control a direction of pivoting steering nozzle 48. In some embodiments, a Hall effect sensor or other type of position sensor is coupled between the steering column 50 and the deck 14 or hull 12 to detect a relative position of the handlebar assembly 52. The position of the handlebar assembly 52 indicated by the position sensor may be used in a steer-by-wire system to control the position of the steering nozzle 48 and/or as an input to an OTS system. The steering column 50 may also or instead be coupled to a steering cable that controls the position of the steering nozzle 48.

When handlebar assembly 42 is pivoted/turned clockwise, W1, steerable nozzle 48 pivots counterclockwise, W2, such that thrust provided by the water jet causes PWC 10 to turn right, R. Similarly, when handlebar assembly 42 is pivoted counterclockwise, W3, steerable nozzle 48 pivots clockwise, W4, such that thrust provided by the water jet causes PWC 10 to turn left, L.

Figure 2:
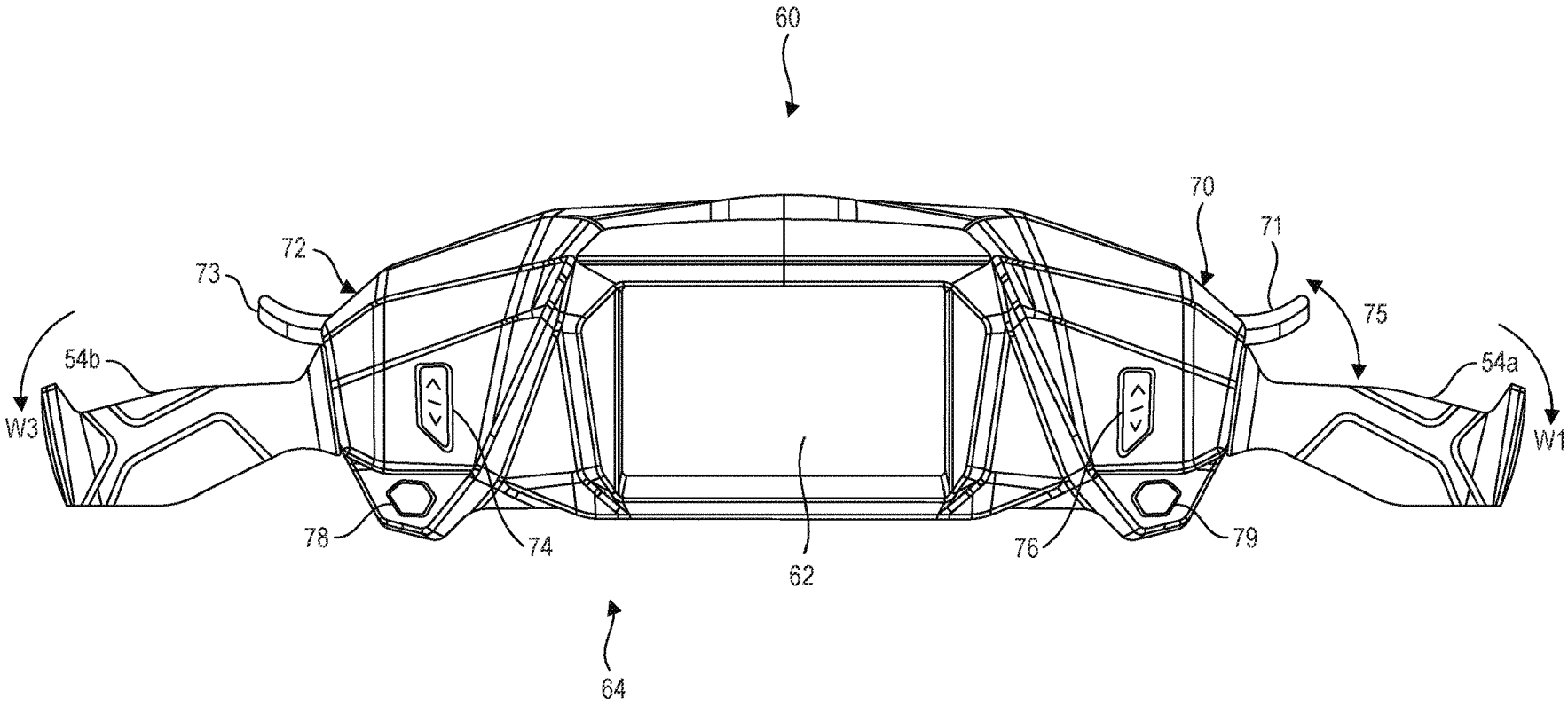
FIG. 2 is a block and schematic diagram generally illustrating a control console suitable for use with a jet propulsion watercraft, according to one example.

With additional reference to FIG. 2, in one example, a control console 60 is coupled to handlebar assembly 52 between right- and left-hand grip ends 54*a* and 54*b* and pivots together with handlebar assembly 52 and steering column 50 about longitudinal axis 51. Control console 60 includes an externally visible display device 62 to display information to an operator (e.g., a driver of PWC 10), including operational information (such as a speed of PWC 10, a rotational speed of the motor (RPMs), a trim angle of the nozzle 48, a state of charge of the battery system 28, a power level available from the electric powertrain 24, among other possible examples). In some examples, as described in greater detail below, display device 62 displays and operational status of the OTS system to an operator. In one example, display device 62 is a digital display screen 62, such as a liquid crystal display (LCD), light emitting diode display (LED), plasma (PDP) display, and a quantum dot (QLED) display, for example.

In addition to display device 62, control console 60 includes a plurality of control mechanisms 64, such as an accelerator 70 (including accelerator lever 71) for controlling the speed of PWC 10, a brake-reverse assembly 72 (including brake-reverse lever 73) for slowing down and/or reversing the PWC 10, mode selector toggle buttons 74 (e.g., to toggle between various operating modes of PWC 10 such as eco, standard, and sport modes), trim control toggle buttons 76 (e.g., to control a trim up/down angle of steering nozzle 38), a power button 78 (to turn PWC 10 on/off), and a cruise control button 79 (to turn cruise control on/off). In examples, accelerator lever 71 is operable over an accelerator actuation range 75 to control electric motor 34 to adjust an amount of thrust provided by the water jet produced by jet propulsion system 26. In one example, when fully released, accelerator lever 71 is considered to be at a position of 0% of accelerator actuation range 75, and at a position of 100% of accelerator actuation range 75 when fully operated. In examples, accelerator assembly 70 and brake-reverse assembly 72 are drive-by-wire assemblies. For example, accelerator assembly 70 and brake-reverse assembly 72 may each include a position sensor (e.g., Hall effect sensor) to measure the position of the accelerator lever 71 and brake-reverse lever 73. It is noted that the type of control mechanisms 66 and their locations on control console 60 represent an illustrative example, and that any number of different types of control mechanisms may be employed at any number of various locations on control console 60. In examples, accelerator 70 may be located on handlebar assembly 52, as illustrated, or at other suitable locations (e.g., a footrest).

Returning to FIG. 1B, according to examples, a control system, CS, including one or more controllers 80 (referred to hereinafter in the singular), controls the operation of PWC 10, including the delivery of power to electric motor 34 from battery system 28 via electronic motor controller 36. In examples, controller 80 is operable to control delivery of electrical power from battery system 28 to electric motor 34 via control of a drive current as a function of one or more input signals received from one or more input devices, such as from control mechanisms 64 of control console 60, including from accelerator 70, and from any number of additional devices and sensors, such as a position sensor (PS) 82 for sensing a rotational position of handlebar assembly 52 (e.g., via drive shaft 50), an accelerometer (ACCL) 84 for sensing acceleration of PWC 10 (e.g., acceleration and deceleration), a gyroscope 86 for sensing an orientation of PWC 10 (e.g., whether PWC 10 is turning), and a GPS system 88 (or, more generally, any form of satellite positioning system). In some embodiments, the additional devices and sensors may include a speed sensor for a watercraft, such as a pilot tube speedometer or a paddle wheel speedometer, for example, to measure a speed of PWC 10 relative to a body of water.

In examples, based on such inputs, including an input indicative of a position of accelerator lever 71 of accelerator 70 within accelerator actuation range 75, controller 80 is operable to control levels of one or more selected operating parameters of electric motor 28, such as a torque or a rotational speed (rpm) of electric motor 28, to thereby control a thrust generated by jet propulsion system 28 and, in-turn, to control the propulsion of PWC 10.

In one example, each position of the accelerator 70 is mapped by controller 80 to a desired level at which to operate the selected operating parameter of the electric motor 34. In examples, a relationship exists between a position of the accelerator 70 and a requested level of an operating parameter at which to operate electric motor 34 (e.g. Nm or rpm). In one example, as the accelerator 70 is actuated (e.g., actuation of accelerator lever 71 over accelerator actuation range 75), controller 80 reads the position of the accelerator 70 at a given frequency (e.g. 1 KHz) and requests electric motor 34 to achieve the level of operating parameter associated with the detected position of accelerator 70. In examples, controller 80 may also control a rate of change (e.g. Nm/ms or rpm/ms), often referred to as the ramp rate, for the selected operating parameter.

As an example, if accelerator 70 is actuated very quickly, controller 80 may limit the time it takes to achieve the requested level of operating parameter associated with the accelerator position based on a permitted ramp rate. For example, if an operator of the vehicle actuates accelerator 70 from a 0% position to a 100% position very quickly, it is possible that the permitted ramp rate will cause electric motor 34 to take longer to achieve 100% of the requested operating parameter than it took the accelerator 70 to move to 100% of its actuation range. In other words, there may be a lag between accelerator 70 (e.g., accelerator lever 71) achieving a given position within accelerator actuation range 75 and electric motor 34 achieving the requested level of operating parameter (e.g. Nm or rpm) associated with that particular accelerator position. In examples, the ramp rate at which the operational parameter is increased/decreased may be selected based on a combination of rider "feel", energy draw from battery system 28, and ease of control of electric motor 34.

The rate of change of the selected operating parameter may be linear in relation to accelerator actuation range 75 of accelerator 70. Alternatively, the rate of change of the selected operating parameter may be non-linear in relation to the accelerator actuation range 75 of accelerator 70. For example, the rate of change of the selected operating parameter may change exponentially, logarithmically or in any other non-linear fashion over the accelerator actuation range 75 of accelerator 70.

During operation of PWC 10, according to examples, an operator (e.g., a driver) controls a position of accelerator 70 within accelerator actuation range 75 to adjust an amount of thrust provided by the water jet generated by jet propulsion system 28 and to thereby control a speed of PWC 10, and rotates handle bar assembly 52 clockwise (W1) and counterclockwise (W3) to pivot steerable nozzle 48 and turn PWC 10 right (R) and left (L). As described above, in instances when evasive maneuvering of PWC 10 is required, such as when attempting to avoid and unexpected obstacle, the operator may quickly turn handlebar assembly 52 and instinctively release or "back off" on accelerator 70 to slow PWC 10. However, if accelerator 70 (e.g., accelerator lever 71) is completely released or is released beyond a certain position within accelerator actuation range 75 (e.g., below a predetermined threshold position), jet propulsion system 28 may provide no thrust, or too little thrust, to enable the PWC 10 to be effectively steered. In other words, PWC 10 relies on thrust from the jet propulsion system 28 in order to turn the craft. Without sufficient thrust, PWC 10 will not respond to an operator's steering inputs and may continue towards the obstacle they want to avoid. In such instances, even though the operator may be turning handlebar assembly 52, due to a lack of thrust, PWC 10 might not turn sharply enough, or fail to turn at all, such that the momentum of PWC 10 may potentially carry PWC 10 into the obstacle.

In such instances, when accelerator 70 is in a released position or "non-actuated position", where such released position may be a fully released position of accelerator 70, or a position which is less than an accelerator OTS threshold position (e.g., a position less than a threshold percentage of the full accelerator actuation range 75) and PWC 10 is turning, OTS system 12, in accordance with the present disclosure, as will be described in greater detail below, provides OTS functionality. Such OTS functionality includes directing electric motor 34 to operate at an OTS (or emergency) operating speed for an OTS (or emergency) duration so as to drive jet propulsion system 28 to provide an OTS (or emergency) steering thrust magnitude to enable the operator to effectively steer PWC 10 for at least the OTS duration to safely avoid the obstacle. In one example, as will be described in greater detail below (e.g., see FIG. 3), OTS system 12 represents a portion of control system, CS, for controlling the operation of electric PWC 10.

While it is beneficial for OTS system 12 to provide OTS functionality in response to the above-described emergency situations, it undesirable for OTS functionality to be unexpectedly activated under non-emergency operating conditions. For example, when the PWC 10 is operational (i.e., powered up and being ridden), it is undesirable for OTS system 12 to activate OTS functionality in response to handlebar assembly 52 being turned when the PWC 10 is in a stopped position or traveling at a low speed (where accelerator 70 is in the so-called non-actuated or released position, where such non-actuated or released position may be a fully released position or a position less than the accelerator OTS threshold position of accelerator actuation range 75), as such activation of OTS functionality could cause PWC 10 to lurch and bump into something in front of, or next to, PWC 10 (such as another vehicle, or a dock or other structure, for example).

With this in mind, OTS system 12, according the present application, employs a two-step process for activating or engaging OTS functionality, wherein a first step includes enabling the OTS functionality for use when PWC 10 exceeds an OTS threshold speed. In one example, OTS threshold speed comprises, or is based on, a predetermined vehicle speed for PWC 10. In one example, the predetermined vehicle speed may be a preselected value. For example, the preselected value may be between 1-20 km/hr, and more particularly may be approximately 15 km/hr. In another example, OTS threshold speed comprises, or is based on, a predetermined motor speed. In one example, the predetermined motor speed may be a preselected value. For example, the preselected value may be between 100-3000 rpm, and more particularly may be approximately 2000 rpm, among other possibilities. In another example, OTS threshold speed comprises, or is based on, an energy bank value that acts as a proxy for a speed of PWC 10. In one example, as discussed in further detail elsewhere herein, the energy bank value may be a preselected value that is determined based on various factors such as a sampling rate and an energy accumulation value.

Once the first step has enabled the OTS functionality for use, a second step includes activating the OTS functionality only when OTS operating conditions are satisfied. In one example, such OTS operating conditions are satisfied when accelerator 70 is in a released or non-actuated position and when PWC is turning. In one example, accelerator 70 is considered to be in released or non-actuated position when accelerator lever 71 is actuated to a position less than an OTS threshold percentage of the accelerator actuation range 75, including at a full released position. If OTS functionality has not been enabled by the first step, OTS system 12 prevents activation of OTS functionality even when the OTS operating conditions of the second step are satisfied.

In one example, OTS system 12 provides an indication of an operation status of OTS functionality to an operator, such as via display device 62 of control console 60. In one example, OTS system 12 directs display device 62 to display an icon (or provide other visual indication, such as an indicator light, for example) indicating when OTS functionality is enabled (e.g., when PWC 10 exceeds the OTS threshold speed). In one example, OTS system 12 directs display device 62 to display a further icon (or further indicator light) indicating when OTS functionality has been activated. In one example, a same icon or indicator light may be employed to indicate both statuses (e.g., the icon or indicator light may be displayed in a first color to provide indication of enablement of OTS functionality, and displayed in a second color to provide indication of activation of OTS functionality). In some examples, the icon or indicator light may be directed to flash and/or control console 60 may be directed to provide audio indication (e.g., an audio alarm) upon activation of OTS functionality.

By employing a two-step process, wherein the first step includes enabling the OTS functionality only when PWC 10 is operating at a speed above an OTS threshold speed, OTS system 12 avoids inadvertently activating OTS functionality in non-emergency situations. For example, OTS system 12 may prevent OTS functionality being activated (and thrust being generated) if an operator inadvertently turns handlebar assembly 52 when PWC 10 is stationary at a dock. Disabling OTS functionality in such a situation may help prevent a collision between PWC 10 and the dock.

Figure 3:
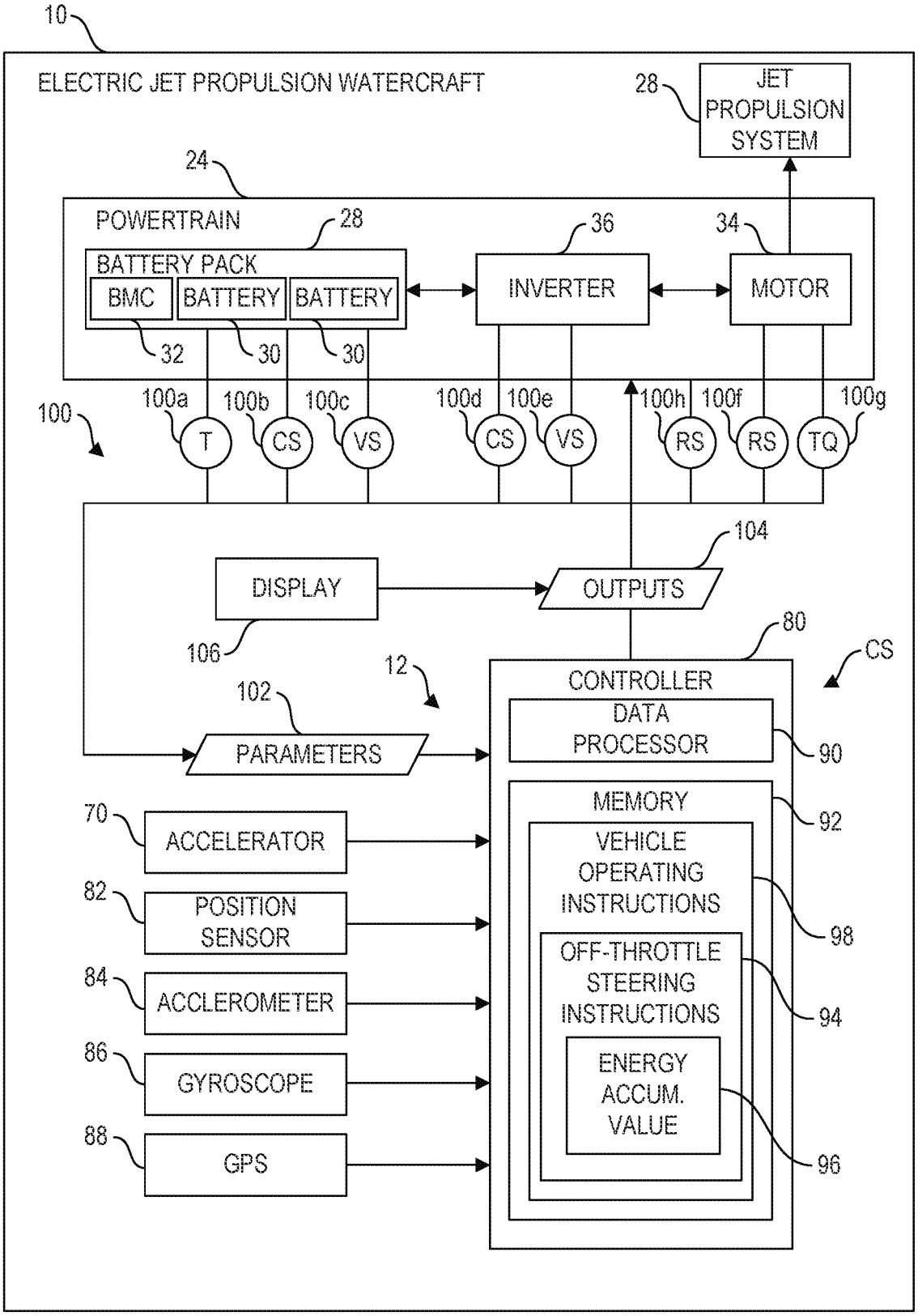
FIG. 3 is a block and schematic diagram generally illustrating a jet propulsion watercraft including an OTS system, according to one example.

FIG. 3 is a block and schematic diagram generally illustrating an electric jet propulsion watercraft, in particular, a PWC, such as PWC 10, including OTS system 12, in accordance with one example of the present disclosure. In one example, OTS system 12 includes one or more inputs, such as from accelerator 70, position sensor 82 (for sensing the rotational position of handlebar assembly 52/steering column 50, e.g., using a Hall effect sensor connected to the steering column 50), accelerometer 84 (for sensing the acceleration of PWC 10), gyroscope 86 (for sensing an orientation of PWC 10, such as whether PWC 10 is tilting), and GPS 88 (for tracking a global position of PWC 10). In one example, OTS system 12 includes one or more data processors, such as data processor 90, and non-transitory machine-readable memory 92 storing machine-readable instructions, such as OTS instructions 94, executable by processor 90 to perform and carry out operations of OTS system 12, in accordance with the present disclosure, and which will be described in greater detail below. In examples, OTS system 12 receives operating parameters 102 from a number of sensors 100 sensing one or more operating parameters of electric powertrain 20, such as temperature sensor 100*a*, current sensor 100*b*, and voltage sensor 100*c* corresponding to battery system 28, current sensor 100*d* and voltage sensor 100*e* corresponding to inverter 36, rotational speed sensor 100*f* (e.g., an encoder or resolver) and output torque sensor 100*g* (e.g., a sensor measuring current in motor windings) corresponding to motor 34, and coolant temperature sensor 100*h*.

In one example, OTS system 12 represents a portion of control system, CS, for controlling the operation of electric PWC 10, with data processor 90 and memory 92 being part of controller 80 which, as described above, forms part of control system, CS. In examples, input devices, including accelerator 70, position sensor 82, accelerometer 84, gyroscope 86, and GPS 88, as well as sensors 100, are included as part of control system, CS, with OTS system 12 operable to receive inputs and sensed operating parameters 102 therefrom. Controller 80 may be operatively connected (e.g., via wired or wireless connections) to a number of input devices, including accelerator 70, position sensor 82, accelerometer 84, gyroscope 86, and GPS 88, and to a number of sensors, including sensors 100, with received inputs and sensed operating parameters 102 used by controller 80 to control operation of electric PWC 10, such as via execution by processor 90 of instructions stored in memory 92, such as vehicle operating instructions 98. In examples, as illustrated, OTS system 12 forms a portion of control system, CS, with OTS system instructions 94 representing a portion of vehicle operating instructions 98. In examples, controller 80 may provide outputs 104 to one or more output devices, such as a display device 106.

Controller 80 may carry out functions in addition to those described herein. Processor 90 may include any suitable device(s) to cause a series of steps to be performed by controller 80 to implement a computer-implemented process such that OTS system instructions 94, together with vehicle operating instructions 98, when executed by controller 80, or other programmable apparatus, carry out method(s) described herein. Processor 90 may include, for example, any type of general purpose microprocessor or microcontroller, a digital signal processing (DSP) processor, an integrated circuit, field programmable gate array (FPGA), a reconfigurable processor, other suitably programmed or programmable logic circuits, or any combination thereof.

Memory 92 may include any suitable machine-readable storage medium, including non-transitory computer readable storage medium such, but not limited to, for example, to an electronic, magnetic, optical, electromagnetic, infrared, or semiconductor system, apparatus, or device, or any suitable combination thereof. Memory 92 may include a suitable combination of any type of machine-readable memory that is located either internally or externally to controller 80. Memory 92 may include any storage means (e.g., devices) suitable for retrievably storing machine-readable instructions executable by processor 90, including OTS system instructions 94 and vehicle operating instructions 98.

Various aspects of the present disclosure may be embodied as systems, devices, methods, and/or computer program products. Accordingly, aspects of the present disclosure may take the form of an entirely hardware embodiment, an entirely software embodiment, or an embodiment combining software and hardware aspects. Furthermore, aspects of the present disclosure may take the form of a computer program product embodied in one or more non-transitory computer readable medium(ia) (e.g., memory 92) having computer readable program code (e.g., vehicle operating instructions 98) embodied thereon. Computer program code for carrying out operations for aspects of the present disclosure in accordance with OTS steering instructions 94, as well as vehicle operating instructions 98, may be written in any programming language or combination of programming languages. Such program code may be executed entirely or in part by controller 80 or other data processing device(s). It is understood that, based on the present disclosure, one skilled in the art could write computer code for implementing the methods described and illustrated herein.

In operation, in accordance with vehicle operating instructions 98, and based at least on inputs from accelerator 70, parameters 102 from one or more sensors 110, and inputs from OTS system 12 (including from one or more of position sensor 82, rotational speed sensor 100*f*, accelerometer 84, gyroscope 86, and GPS 88), controller 80 provides outputs 104 to powertrain 24 to control delivery of DC electric power from battery system 28 to inverter 36, and to control delivery of an AC waveform from inverter 36 to control operation of electric motor 34. In examples, in response to actuation of accelerator 70, and specifically based on a position of accelerator 70 and, in some cases, in response to OTS system 12, controller 80 adjusts characteristics of the AC waveform (e.g., frequency and amplitude of voltage and current waveforms) delivered to motor 34 by inverter 36 to control levels of one or more selected operating parameters of motor 34 (such as a rotational speed (rpm) and/or an output torque, for example) to implement a desired response and expected performance of electric motor 34 and control an amount of thrust provided by jet propulsion system 28.

In one example, OTS system 12 includes at least one device to provide at least one output indicative of a speed of PWC 10, and a controller, such as controller 80, which enables off-throttle steering (OTS) functionality when the output indicates that the PWC 10 exceeds a predetermined OTS threshold speed. In one example, such at least one device comprises a speed sensor, wherein the output of the speed sensor (e.g., a first output) is provided to controller 80. In one example, such at least one device comprises accelerometer 84, wherein the output of accelerometer 84 (e.g., a first output) is provided to controller 80, which derives a speed of PWC 10 therefrom. In another example, such at least one device comprises GPS 88, where the output of GPS 88 (e.g., a first output) is provided to controller 80, which derives a speed of PWC 10 therefrom. In one example, such first device comprises one of a rotational speed sensor 100*f* or an output torque sensor 100*g* corresponding to motor 34, where the output of one or both of sensors 100*f*, 100*g* is provided to controller 80, which derives an operating speed of PWC 10 therefrom. In one example, the at least one device may comprise two or more devices that each provide an output, wherein the controller 80 derives a speed of PWC 10 on the basis of the combined outputs. In one example, the predetermined OTS threshold speed is a preselected value, such as a vehicle speed of 15 km/hr, for example, or a motor speed of 2000 rpm, for example.

In one example, OTS system 12 determines whether PWC 10 is traveling at a speed which meets the OTS threshold speed based on a value of an energy bank which acts as a proxy for the operating speed of PWC 10. As will be described in greater detail below (see FIG. 4), during operation of PWC 10, starting from an initial value (e.g., from a value of zero), OTS system 12 periodically monitors (e.g., at a sampling rate) the operating speed of PWC 10 (such as via a position of accelerator 70 or a rotational speed of electric motor 34) and increments or decrements the value of the energy bank based on whether the monitored speed exceeds a threshold speed, with a current value of the energy bank being indicative of whether PWC 10 is likely operating at a speed which exceeds the predetermined OTS threshold speed. Because the value of the energy bank is dynamically incremented and decremented over time based on the speed of PWC 10, the current value of the energy bank is indicative of an amount of energy recently consumed by PWC 10 and, thus, indicative of a current speed at which PWC 10 is traveling, where such indication of the current speed is not dependent on a current position of accelerator 70 or a current rotational speed of electric motor 34 (or a current position of whatever device is employed to measure a speed of PWC 10).

In one example, once the OTS functionality is enabled, OTS system 12 monitors a number of OTS operating conditions, and activates the OTS functionality when the OTS operating conditions are satisfied. In one example, the OTS operating conditions include whether accelerator 70 is in a non-actuated, or near non-actuated, position (e.g., accelerator 70 has been released) and whether PWC 10 is being turned or attempting to be turned by an operator. In examples, controller 80, as described above, already monitors the position of accelerator 70 when determining how to control electric motor 35 to drive jet propulsion system 28 to output an amount of thrust to propel PWC 10. In one example, controller 80 monitors the position of accelerator 70 and deems accelerator 70 as being in a non-actuated position (i.e., released) when accelerator 70 is actuated to a position which is less than an OTS accelerator threshold position (which may be within 0-5% of accelerator actuation range, for example). In one example, the OTS accelerator threshold position is a preselected percentage of the total accelerator actuation range 75 of accelerator 70, such as 5% of the accelerator actuation range 75, for instance. In other words, if accelerator 70 is actuated to a position which is less than or equal to the first 5% of the accelerator actuation range 75, accelerator 70 is deemed to be in a non-actuated or released position. In other examples, if accelerator 70 is actuated to a position which is less than or equal to the first 2% or the first 3% of the accelerator actuation range 75, accelerator 70 is deemed to be in a non-actuated or released position.

In examples, PWC 10 is deemed to be turning when handlebar assembly 52 and/or steering column 50 is turned to a position which is greater than an OTS steering angle threshold. In one example, the OTS steering angle threshold is a preselected percentage of a total rotational range of handlebar assembly 52 and/or steering column 50 in either clockwise direction, W1, or counterclockwise direction, W3, from a center or straight position. Non-limiting examples of this preselected percentage include 5%, 10%, 30%, 50%, 70% or 90% of the total rotational range of handlebar assembly 52 and/or steering column 50 in either direction, for instance. In other words, PWC 10 is deemed to be turning when handlebar assembly 52 and/or steering column 50 is deemed to be rotated more than the preselected percentage of the total rotational range of handlebar assembly 52 in either clockwise direction W1 or counter-clockwise direction W3. In some examples, the preselected percentage of a total rotational range of handlebar assembly 52 and/or steering column 50 that defines the OTS steering angle threshold may be close to the total rotational range (e.g., more than 60%), where handlebar assembly 52 is considered "fully locked". This may correspond to a 30 degree or more rotation of steering column 50 in either clockwise direction W1 or counter-clockwise direction W3.

In some examples, values of the OTS threshold speed and/or the OTS steering angle threshold may vary based on how fast the PWC 10 is travelling, a rate of actuation of turning the handlebar assembly 52 and/or steering column 50, as well as the operating mode of the PWC 10. For example, the faster the PWC 10 is travelling may cause the OTS steering angle threshold to decrease. Likewise, if the operating mode of the PWC 10 is in a sport mode having an increased acceleration capability (i.e., acceleration ramp rate), the OTS steering angle threshold may be less than when the PWC 10 is in an eco-mode having a reduced acceleration capability.

In one example, OTS system 12 includes a third device (in addition to the first device and accelerator 70) to provide a third output indicative of the steering angle of handlebar assembly 52 and/or steering column 50. In one example, such third device comprises gyroscope 86, wherein the output of gyroscope 86 (i.e., the third output) is provided to controller 80 which determines a steering angle of handlebar assembly 52 and/or steering column 50 therefrom. In another example, such third device comprises position sensor 82, wherein the output of position sensor 82 (i.e., the third output) is provided to controller 80 which determines a steering angle of handlebar assembly 52 and/or steering column 50 therefrom. If the determined steering angle of handlebar assembly 52 and/or steering column 50 is greater than the OTS steering angle threshold, PWC 10 is deemed to be turning, or attempting to be turned.

If the OTS functionality is not enabled (i.e., the speed of PWC 10 is deemed to not have exceeded the OTS threshold speed), controller 80 prevents the OTS functionality from being activated regardless of whether the OTS operating conditions are satisfied. If the OTS functionality is enabled (i.e., the speed of PWC 10 is deemed to have exceeded the OTS threshold speed), but the OTS operating conditions are not satisfied, controller 80 again prevents the OTS functionality from being activated.

However, if the OTS functionality is enabled and the OTS operating conditions have been satisfied (e.g., accelerator 70 is deemed to be in a non-actuated position, and PWC is deemed to be turning or attempting to be turned), controller 80 activates the OTS functionality, where such OTS functionality includes directing electric motor 34 to operate at an OTS (or emergency) operating speed for an OTS (or emergency) duration so as to drive jet propulsion system 28 to provide an OTS (or emergency) steering thrust magnitude to enable PWC 10 to be effectively steered for at least the OTS duration. In one example, the OTS operating speed is a predetermined speed value (rpm), such as 20% of a maximum operating speed of electric motor 34, and the OTS duration is a predetermined duration, such as 5 seconds, among other possibilities.

In other examples, the OTS operating speed of electric motor 34 and the OTS duration may vary based on operating conditions of PWC 10. For example, if position sensor 82 or gyroscope 86 (or other sensor) provides indication of a very quick turning of handlebar assembly 52, the OTS operating speed of electric motor 34 and/or OTS duration may be increased, such as from respective base settings. In other words, the OTS operating speed and/or the OTS duration may vary depending on the rate of actuation of the handlebar assembly 52 and/or the steering column 50. In some embodiments, a faster rate of actuation of the handlebar assembly may indicate a more aggressive emergency maneuver is required. Accordingly, in some embodiments, the faster the rate of actuation (i.e. turning) of the handlebar assembly 52 and/or the steering column 50 by an operator, the faster an OTS operating speed may be commanded to the motor 34. Similarly, the faster the rate of actuation (i.e. turning) of the handlebar assembly 52 and/or the steering column 50 by an operator, the longer the OTS duration may last. In one example, if accelerometer 84 or GPS 88 (or other sensor, see the energy accumulation bank of FIG. 4 below, for example) provides indication that PWC is traveling at a high speed, the OTS operating speed of electric motor 34 and/or OTS duration may be increased, such as from respective base settings. In other words, the OTS operating speed and/or the OTS duration may vary depending on a determined speed of the PWC 10 (which may be a determined energy bank assessment). The faster the PWC 10 is travelling may require a more aggressive (e.g. faster) OTS operating speed to perform an emergency maneuver. Accordingly, in some embodiments, the faster the PWC 10 is travelling, the greater the OTS operating speed that may be commanded to the motor 34. Similarly, the faster the PWC 10 is traveling, the longer the OTS duration may last.

In another example, the OTS operating speed and/or OTS duration may vary based on an operating mode of PWC 10 (e.g., whether operating in eco mode, normal mode, or sport mode), wherein the OTS operating speed and/or OTS duration may be greater for sport mode than eco mode, for instance. In other examples, values of the OTS threshold speed and/or the OTS steering angle threshold may vary based on the operating mode of PWC 10.

In one example, in lieu of determining whether an operating speed of PWC 10 exceeds an OTS threshold speed based on outputs from accelerometer 84, GPS 88 and/or a watercraft speed sensor, an energy accumulation bank (or energy accumulation value) is employed as a proxy for the operating speed of PWC 10. Optionally, the energy accumulation bank may be used as a secondary or backup means of determining whether an operating speed of PWC 10 exceeds an OTS threshold speed. For example, determining the speed of PWC 10 using GPS data may be a primary form of speed measurement but, in the case that GPS data is deemed unavailable or unreliable (e.g., if GPS 88 is connected to too few satellites to achieve accurate measurements), then the energy accumulation bank may be implemented as a proxy for the operating speed of PWC 10.

In one example, the energy accumulation bank comprises a dynamically adjusted value which may be representative of a vehicle parameter, such as the position of accelerator 70 within accelerator actuation range 75 and/or a rotational speed of the motor 34 over time during operation of PWC 10. The value of the energy accumulation bank may provide an indication of whether PWC 10 is traveling at a speed at which the OTS functionality should be enabled (i.e., at a speed exceeding the OTS threshold speed). In one example, controller 80 enables OTS functionality when the energy accumulation bank has a value at least equal to an energy accumulation bank threshold value.

In one example, a position of accelerator 70 (e.g., accelerator lever 71) within accelerator actuation range 75 is measured (or sampled) at a sampling rate, such as at sampling rate of between 250 Hz to 2 kHz (i.e., 250 to 2,000 times per second). In one example, for each sample, if the position of accelerator 70 is greater than a predetermined accelerator threshold position (which may also be referred to herein as an "accelerator threshold value"), such as greater than 50% of the throttle actuation range 75, controller 80 increments the energy accumulation bank by a first count (sometimes referred to as an "incremental count"). It should be understood that, in some embodiments, the accelerator threshold value may be any value greater than 10% of the throttle actuation range, greater than 20% of the throttle actuation range, greater than 30% of the actuation range or greater than 40% of the actuation range. The accelerator threshold value may be set depending on a desired level of sensitivity of the OTS system 12.

In one example, the first count may be a value of 2, or any other selected value. At each sample, the energy accumulation bank increases by 2 (or the selected value) if the accelerator 70 is activated at greater than the accelerator threshold value (which may be 50% of the accelerator actuation range, for example). As the user continues to actuate the accelerator beyond the accelerator threshold value, the energy accumulation bank increases. The rate at which the energy accumulation bank may increase will be based at least in part on the sampling frequency. A higher sampling frequency will result in a faster increase in the energy accumulation bank value than a lower sampling frequency. Once the energy accumulation bank has increased beyond an energy accumulation bank threshold value, the OTS functionality may be enabled. The predetermined energy accumulation bank threshold value may be determined based on a value of the incremental count (e.g. such as a value of 2), the sampling frequency (e.g. fast or slow sampling frequency) as well as a temporal component. For example, the predetermined energy accumulation bank threshold value may be based on an assumption that if an operator has actuated the accelerator 70 beyond the accelerator threshold value for greater than a couple of seconds (e.g. between 1.5 and 5 seconds) then the OTS functionality should be enabled. Based on that assumption, an energy accumulation bank threshold value may be determined by multiplying the temporal component by the sampling rate by the incremental count.

Once the energy accumulation bank has started to increase by the incremental count (e.g. a value of 2), the energy accumulation bank may also decrement the energy bank by a second count (e.g. a value of 1) each time the operator releases the accelerator 70 below the accelerator threshold value, which may be 50% of the accelerator actuation range, for example. In one example, for each sample at which accelerator is less than 50% of the throttle actuation range 75, controller 80 decrements the energy accumulation bank by a second count. The second count (i.e. the decremental count) may be less than the incremental count such that the energy accumulation bank is biased towards accumulation. In one example, the second decremental count may be a value of 1, while the incremental count is a value of 2, such that the energy accumulation bank increases faster than it decreases. In other words, when starting from an initial value of zero, it takes less time for energy accumulation bank to reach the energy accumulation bank threshold value at which controller 80 enables OTS functionality, than for the value of the energy accumulation bank to decrease to a point where the OTS functionality becomes disabled. In alternative examples, the second count (i.e. the decremental count) may be greater than the incremental count such that the energy accumulation bank is biased towards decumulation and it takes more time for energy accumulation bank to reach the energy accumulation bank threshold value at which controller 80 enables OTS functionality, than for the value of the energy accumulation bank to decrease to a point where the OTS functionality becomes disabled.

Once the OTS functionality is enabled, it may not be disabled until the energy accumulation bank decreases back to a value of zero. Alternatively, the OTS functionality may be disabled once the energy accumulation bank decreases below the energy accumulation bank threshold value. In yet another example, the OTS functionality may be disabled once the energy accumulation bank decreases below a predetermined value less than the energy accumulation bank threshold value.

In some embodiments, there may be a range of accelerator positions within the throttle actuation range 75 where the value of the energy accumulation bank is neither incremented nor decremented. In such embodiments, the accelerator threshold value for incrementing the energy accumulation bank may be higher than the accelerator threshold value for decrementing the energy accumulation bank. Between these two accelerator threshold values may be "neutral" accelerator positions where the watercraft is substantially neither gaining nor losing speed, and the energy accumulation bank value is unchanged.

In some embodiments, the value of the energy accumulation bank might be determined based on a predetermined relationship between the speed of PWC 10 and the position of accelerator 70. This predetermined relationship, which may be linear or non-linear, may include (or be based on) a mapping of positions of accelerator 70 to experimentally determined speeds of PWC 10. Using the predetermined relationship, the value of the energy accumulation bank may be incremented or decremented by variable (e.g., non-integer) values for each sample of accelerator position. The predetermined relationship may also implement a function to reflect that the speed of PWC 10 might change more slowly than the position of accelerator 70 (e.g., as it may take longer for PWC 10 to speed up and slow down than it takes to actuate accelerator 70). Such a function may include a low-pass filter or hysteresis to capture lag in changes in the speed of PWC 10 as compared to changes in the position of accelerator 70. In other words, the value of the energy accumulation bank may reflect that the ramp-up and slow-down of PWC speed may be delayed relative to accelerator actuation. In some embodiments, for each sample of the position of accelerator 70, the value of the energy accumulation bank may be calculated based on that sample and previous samples over a period of time. For example, the positions of accelerator 70 may be integrated over a period of time to generate a value of the energy accumulation bank acting as a proxy for the speed of PWC 10.

In one example, when the energy accumulation bank is at least equal to the energy accumulation bank threshold value, meaning that the OTS functionality is enabled, controller 80 activates the OTS functionality when the OTS operating conditions are satisfied, as described above (e.g., accelerator 70 is deemed to be in a non-actuated position, and PWC 10 is deemed to be turning or attempting to be turned). It is noted that the value of the first and second counts (i.e. incremental count and decremental count), the sampling rate, the predetermined actuation value, and the accumulation bank threshold value may be different from the example values described above.

While the above example of the energy accumulation bank has been described in relation to the incremental and decremental counts being based on the sampled position of the accelerator 70, in other embodiments, the energy accumulation bank incremental and decremental counts may be based on another parameter that may act as a proxy for vehicle speed. For example, the incremental and decremental counts could be based on a sampled reading of the motor rotation from the rotational speed sensor 100*f*. In one example, an incremental count may occur every time the sampled rotational speed from the rotational speed sensor 100*f* is above a predetermined threshold speed, such as 1000 rpm for example, and a decremental count may occur every time the sampled rotational speed from the rotational speed sensor 100*f* is below a predetermined threshold speed. In another example, the value of the energy accumulation bank might be based on a predetermined relationship between the speed of PWC 10 and the sampled rotational speed from the rotational speed sensor 100*f* over a period to time, to capture lag in changes in the speed of the PWC relative to changes in rotation speed. The below flow diagram illustrating a method 200 of operating OTS system when employing an energy accumulation bank is explained using a sampled accelerator 70 position, but could also have been explained using a sampled motor rotational speed reading.

Figure 4:
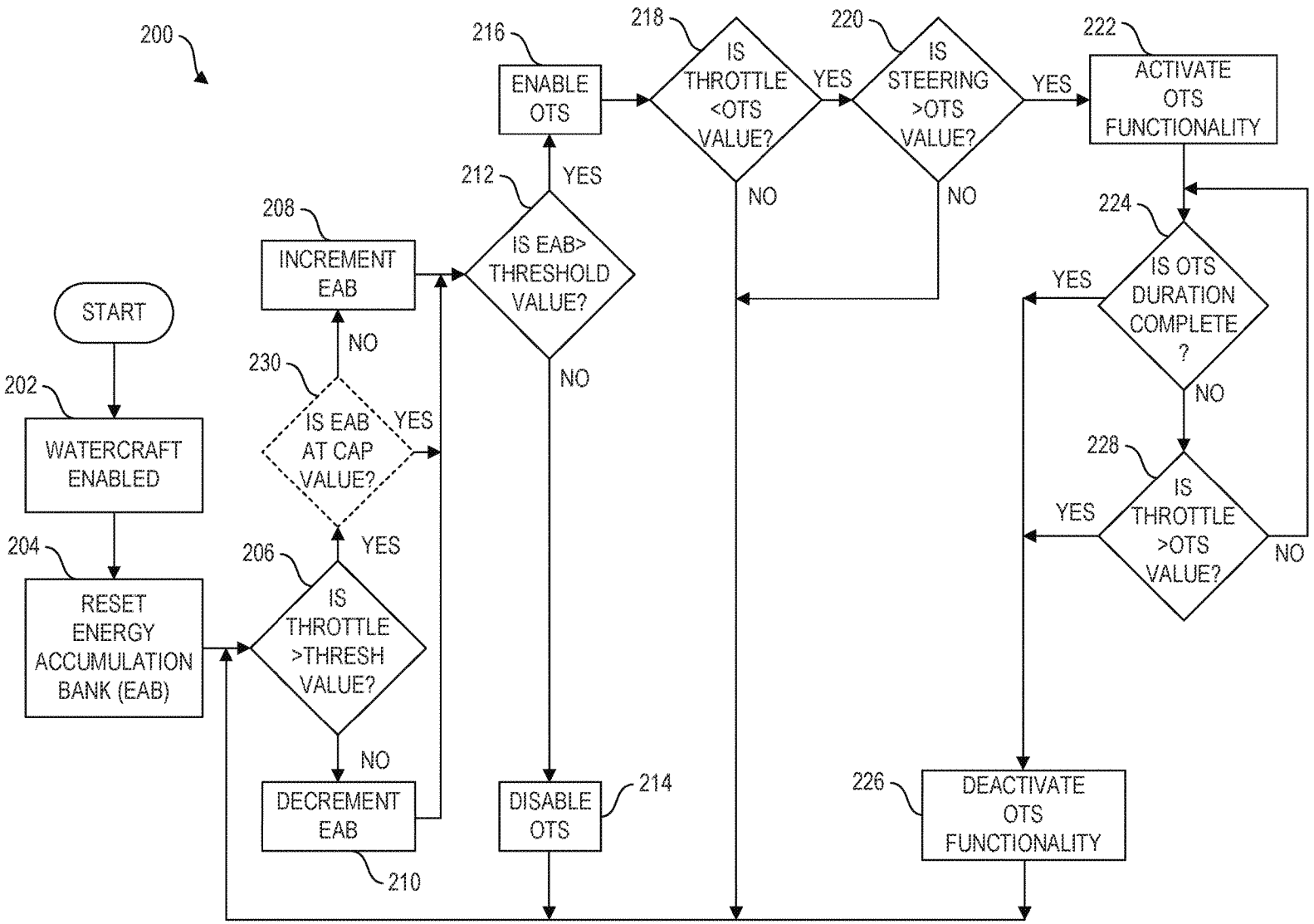
FIG. 4 is a flow diagram generally illustrating a method of operating a vehicle including an OTS system, according to examples of the present disclosure.

FIG. 4 is a flow diagram illustrating a method 200 of operating OTS system 12 when employing an energy accumulation bank as proxy for an operating speed of PWC 10, according to one example of the present disclosure. In one example, method 200 begins at 202 with the jet propulsion watercraft, such as PWC 10, being enabled (e.g., being powered-up). At 204, the energy accumulation bank (EAB) is set/reset to an initial value, such as to an initial value of zero, for example.

Method 200 then proceeds to 206, where the position of the accelerator 70, such as a position of accelerator lever 71, within accelerator actuating range 75, is sampled. If the sampled position is greater than the throttle threshold value (e.g., accelerator threshold value may be equal to 50% of the throttle actuation range 75), method 200 proceeds to 208, where EAB is incremented by an increment value (e.g., a value of 2). If the sampled position is not greater than the throttle threshold value, method 200 proceeds to 210, where EAB is decremented by a decrement value (e.g., a value of 1).

After incrementing the EAB at 208, or decrementing the EAB at 210, method 200 proceeds to 212, where it is queried whether the EAB has a value greater than an EAB threshold value (e.g., which may be a value of 5,000, for example). If the answer to the query is "no", meaning that the operating speed of PWC 10 likely does not exceed the OTS threshold speed, method 200 proceeds to 214, where controller 80 maintains OTS functionality in a disabled state, and then returns to 206 to process another sampled position of accelerator 70. If the answer to the query is "yes", meaning that the speed of PWC 100 exceeds the OTS threshold speed, method 200 proceeds to 216 where controller 80 enables OTS functionality.

Method 200 then proceeds to 218 where it queries whether a position of accelerator 70 is greater than an OTS accelerator threshold position (e.g., actuated to a position which is less than 5% of the accelerator actuation range 75). If the answer to the query at 218 is "no", method 200 returns to 206 to process another sample of the position of accelerator 70. If the answer to the query at 218 is "yes", method 200 proceeds to 220 where it is queried whether handlebar assembly 52/steering column 50 is turned at steering angle which exceeds an OTS steering angle threshold. In examples, as described above, a steering angle of handlebar assembly 52/steering column 50 may be determined based on outputs provided by position sensor 82 or gyroscope 86, for example. If the answer to the query at 220 is "no", meaning that a steering angle at which handlebar assembly 52 is positioned does not exceed the OTS steering threshold angle (and meaning that PWC 10 is not turning or not attempting to be turned), method 200 returns to 206 to process another sample of the position of throttle 70.

If the answer to the query at 220 is "yes", meaning that a steering angle at which handlebar assembly 52 is position exceeds the OTS steering threshold angle (and meaning that PWC is turning or that an operator is attempting to turn the PWC 10), the OTS operating conditions are met (i.e., throttle 70 is released to a non-actuated position and PWC 10 is turning or attempting to be turned). Method 200 proceeds to 222 where controller 80 activates the OTS functionality by instructing electric motor 34 to operate at the OTS operating speed for the OTS duration. In this manner, when the OTS functionality is activated, the PWC 10 provides the rider with the ability to steer the PWC 10 regardless of whether the rider has released the accelerator 70 to a non-actuated or released position.

Method 200 then proceeds to 224 where it queries whether the OTS duration is complete. If the answer to the query at 224 is "yes", meaning that the OTS duration has expired, method 200 proceeds to 226 where controller 80 deactivates the OTS steering functionality. If the answer to the query at 224 is "no", method 200 proceeds to 228 where it is queried whether a position of accelerator 70 is greater than the OTS accelerator threshold position. If the answer to the query at 228 is "yes", meaning that the operator of PWC 10 has once again begun actuating accelerator 70, method 200 proceeds to 226. If the answer to the query at 228 is "no", method 200 returns to 224.

In one example, an alternative of method 200 includes a query at 230 as to whether the value of the EAB has reached a cap value. In examples, the EAB cap value is greater than the EAB threshold value at 212, and is intended to prevent the EAB from obtaining a large value that would require a lengthy time period for the value of the EAB to be decremented to a value less than the EAB threshold, where during such time period PWC 10 could be stopped (e.g., the accelerator released) and the OTS functionality inadvertently activated if an operator turns handlebar assembly 52. In one example, the EAB cap value is larger than EAB threshold value by a percentage of EAB threshold value, such as 20% large, for example. If the answer to the query at 230 is "no", method 200 proceeds to increment the EAB at 208. If the answer to the query at 230 is "yes", method 200 skips 208 (i.e., the EAB is not incremented) and proceeds to 212.

Figure 5:
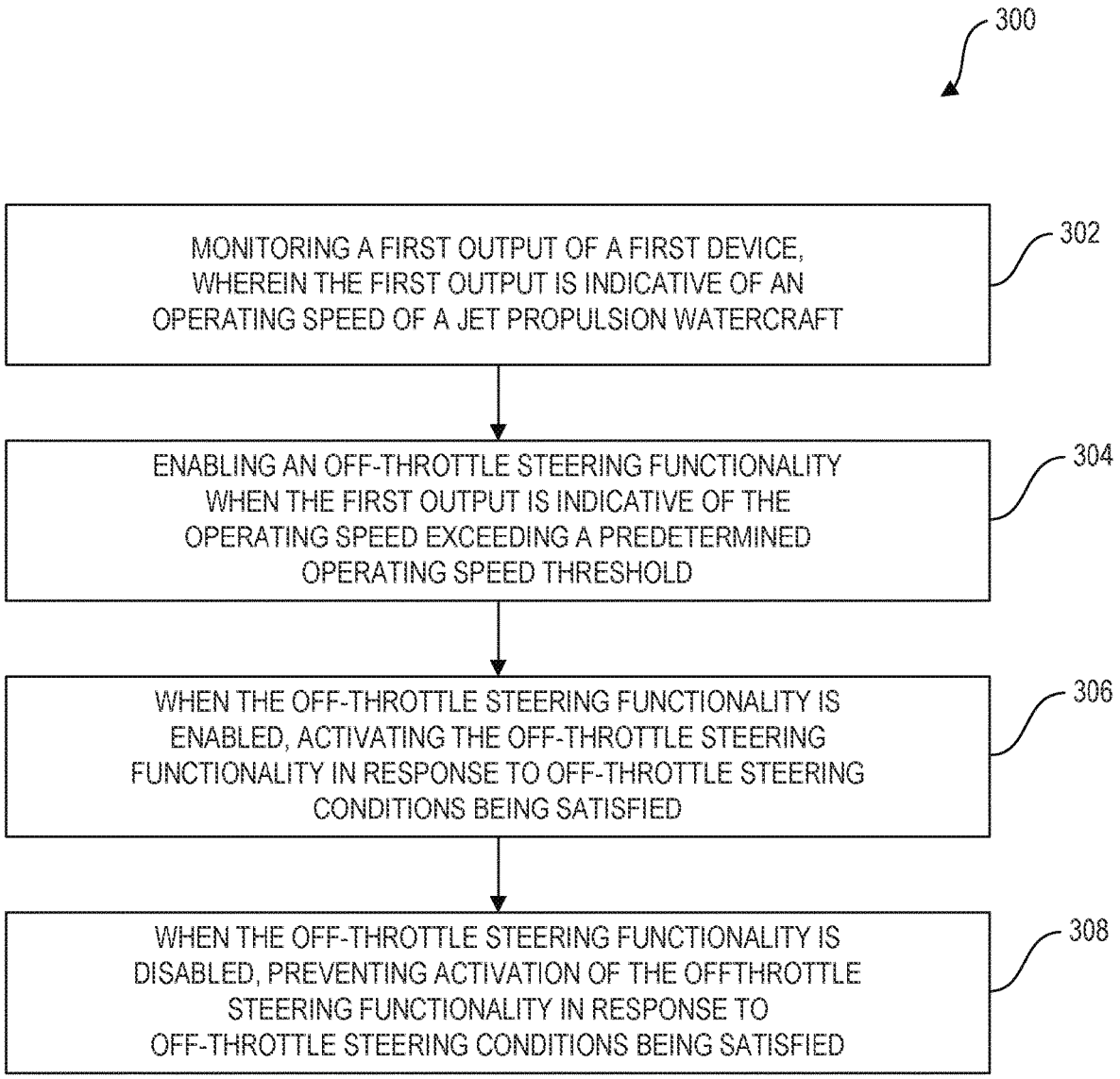
FIG. 5 is a flow diagram generally illustrating another method of operating a vehicle including an OTS system, according to examples of the present disclosure.

FIG. 5 is a flow diagram generally illustrating a method 300 of operating OTS system 12 for a jet powered watercraft, such as electric PWC 10, according to one example. Method 300 begins at 302 with monitoring a first output of a first device, wherein the first output is indicative of an operating speed of the jet propulsion watercraft, such as controller 80 monitoring an output of one of an accelerometer 84, GPS receiver 88, speed sensor of PWC, and/or an energy accumulation bank of PWC 10, for example.

At 304, method 300 includes enabling an off-throttle steering functionality when the first output is indicative of the operating speed exceeding an OTS threshold speed. At 306, when the off-throttle steering functionality is enabled, method 300 includes activating the off-throttle steering functionality in response to off-throttle steering conditions being satisfied, such as controller 80 activating off-throttle steering functionality for PWC 10 when accelerator 70 is in a non-actuated position, and when handlebar assembly 52/steering column 50 is turned clockwise or counter-clockwise beyond an OTS steering angle threshold. At 308, when the off-throttle steering functionality is disabled, method 300 includes preventing activation of off-throttle steering functionality in response to off-throttle steering conditions being satisfied.

The term "off-throttle steering" as used herein is not intended to be limited to use with vehicles that include traditional throttle actuators that control a throttle valve for providing fuel to a combustion engine vehicle. It is used simply for historic reasons. The term OTS as used herein is intended to broadly encompass functionality that provides thrust during steering when an operator ceases to provide an input that would normally command the vehicle to provide thrust. For example, the term "off-throttle steering" could easily have been replaced with "off-accelerator steering".

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein.

Example embodiments will now be provided.

Example embodiment 1: An electric watercraft comprising: a jet propulsion system to form a water jet to provide thrust to propel the watercraft; an electric motor to drive the jet propulsion system; a battery system to power the motor; an accelerator which can be actuated over an accelerator actuation range to control the motor to adjust an amount of thrust provided by the water jet; a steering mechanism operable over a steering range to steer the watercraft; and a controller to: receive information indicative of a speed of the watercraft; and enable an otherwise disabled off-throttle steering functionality when the speed of the watercraft exceeds a predetermined speed threshold; when the off-throttle steering functionality is enabled, activate the off-throttle steering functionality in response to off-throttle steering conditions being satisfied; and when the off-throttle steering functionality is disabled, prevent activation of the off-throttle steering functionality when the off-throttle steering conditions are satisfied.

Example embodiment 2: The watercraft of example embodiment 1, wherein the off-throttle steering conditions are satisfied when: the accelerator is in a non-actuated position; and the steering mechanism is in an operated position which exceeds a steering angle threshold of a steering range of the steering mechanism.

Example embodiment 3: The watercraft of example embodiment 2, wherein the accelerator is in a non-actuated position when a position of the accelerator within the accelerator actuation range does not exceed an accelerator threshold position.

Example embodiment 4: The watercraft of example embodiment 3, wherein the position of the accelerator within the accelerator actuation range is determined via a position sensor associated with the accelerator.

Example embodiment 5: The watercraft of example embodiment 2, wherein an operated position of the steering mechanism is determined via one of a position sensor associated with the steering mechanism and a gyroscope.

Example embodiment 6: The watercraft of example embodiment 1, wherein the off-throttle steering functionality comprises commanding the electric motor to drive the jet propulsion system to provide an off-throttle steering thrust magnitude for an off-throttle steering thrust duration.

Example embodiment 7: The watercraft of example embodiment 6, wherein the off-throttle steering thrust magnitude and off-throttle steering thrust duration have predetermined fixed values.

Example embodiment 8: The watercraft of example embodiment 6, the controller to provide a variable off-throttle steering thrust magnitude and/or variable off-throttle steering thrust duration based on one or more of the speed of the watercraft and a rate at which the steering mechanism is operated.

Example embodiment 9: The watercraft of example embodiment 1, including a first device to provide the information indicative of the speed of the watercraft, the first device comprising one of a GPS receiver and an accelerometer.

Example embodiment 10: The watercraft of example embodiment 1, wherein information indicative of a speed of the watercraft comprises information which acts as a proxy for the speed of the watercraft.

Example embodiment 11: The watercraft of example embodiment 10, wherein the information indicative of a speed of the watercraft is provided in the form of an energy accumulation value of an energy accumulation bank.

Example embodiment 12: The watercraft of example embodiment 11, the controller to: sample an operating parameter of the watercraft at a sampling rate; dynamically adjust the energy accumulation value based on each sample, wherein a present value of the energy accumulation value is representative of a speed of the watercraft; and enable the otherwise disabled off-throttle steering functionality when the energy accumulation value exceeds a threshold energy accumulation value.

Example embodiment 13: The watercraft of example embodiment 12, the operating parameter sampled comprises a position of the accelerator within the accelerator actuation range.

Example embodiment 14: The watercraft of example embodiment 12, the operating parameter sampled comprises a rotational speed of the electric motor.

Example embodiment 15: The watercraft of example embodiment 12, beginning at an initial value, the controller to increment the energy accumulation value by a first value when the operating parameter sample exceeds a threshold value, and to decrement the energy accumulation value by a second value when the operating parameter sample does not exceed the threshold value.

Example embodiment 16: The watercraft of example embodiment 15, the first amount being greater than the second amount.

Example embodiment 17: The watercraft of example embodiment 15, the initial value being zero.

Example embodiment 18: The watercraft of example embodiment 15, the energy accumulation value having a cap value greater than the threshold energy accumulation value, the controller to not increment the energy accumulation value by the first amount when the energy accumulation value is at the cap value.

Example embodiment 19: The watercraft of example embodiment 15, the controller to reset the energy accumulation value to the initial value each time the watercraft is turned off.

Example embodiment 20: A watercraft comprising: a jet propulsion system to form a water jet to provide thrust to propel the watercraft; a driver unit to drive the jet propulsion system; an accelerator which can be actuated over an accelerator actuation range to control the driver to adjust an amount of thrust provided by the water jet; a steering mechanism operable over a steering range to steer the watercraft; a first device to provide a first output having a value representing a first operating parameter indicative of a speed of the watercraft; and a controller to: sample the value of the first output at a sampling rate; dynamically adjust an energy accumulation value based on each sample value of the first output, wherein a present value of the energy accumulation value is representative of a speed of the watercraft; enable off-throttle steering functionality of the watercraft when the energy accumulation value exceeds a threshold energy accumulation value, otherwise to disable off-throttle steering of the watercraft.

Example embodiment 21: The watercraft of example embodiment 20, the first device comprising a position sensor to sense a position of the accelerator within the accelerator actuation range.

Example embodiment 22: The watercraft of example embodiment 20, the first device comprising a speed sensor to detect a rotational speed of the electric motor.

Example embodiment 23: The watercraft of example embodiment 20, beginning at an initial value, for each sample of the first output, the controller to increment the energy accumulation value by a first amount when the operating speed exceeds an operating speed threshold, and to decrement the energy accumulation value by a second amount when the operating speed does not exceed the operating speed threshold.

Example embodiment 24: The watercraft of example embodiment 23, the first amount being greater than the second amount.

Example embodiment 25: The watercraft of example embodiment 23, the initial value being zero.

Example embodiment 26: The watercraft of example embodiment 23, the energy accumulation value having a cap value greater than the threshold energy accumulation value, the controller to not increment the energy accumulation value by the first amount when the energy accumulation value is at the cap value.

Example embodiment 27: The watercraft of example embodiment 23, the controller to reset the energy accumulation value to the initial value each time the watercraft is turned off.

Example embodiment 28: The watercraft of example embodiment 20, further including: a second device to provide a second output having a value representing a second operating parameter indicative of a watercraft turning parameter; when the off-throttle steering functionality is enabled, when the accelerator is operated at a position below an accelerator threshold position of the accelerator actuation range, and the second output value exceeds a threshold value of the second operating parameter, the controller to activate off-throttle steering functionality by directing the motor to drive the jet propulsion system to provide an off-throttle steering thrust magnitude for an off-throttle steering thrust duration.

Example embodiment 29: The watercraft of example embodiment 28, wherein the second device comprises a position sensor to sense a position of the steering mechanism within a steering mechanism range.

Example embodiment 30: The watercraft of example embodiment 28, the second device comprising a gyroscope to sense whether the watercraft is turning.

Example embodiment 31: The watercraft of example embodiment 28, wherein the off-throttle steering thrust magnitude and off-throttle steering thrust duration have predetermined fixed values.

Example embodiment 32: The watercraft of example embodiment 28, the controller to provide a variable off-throttle steering thrust magnitude and/or variable off-throttle steering thrust duration based on one or more of the value of the second operating parameter, a rate at which the steering mechanism is operated, and the value of the energy accumulation value.

Example embodiment 33: The watercraft of example embodiment 20, wherein the driver unit comprises an electric motor powered by a rechargeable battery system.

Example embodiment 34: The watercraft of example embodiment 20, wherein the driver unit comprises an internal combustion engine.

Example embodiment 35: A method of operating an electric jet propulsion watercraft including: monitoring an operating speed of the watercraft; enabling an otherwise disabled off-throttle steering functionality when the operating speed of the watercraft exceeds a predetermined operating speed threshold; when the off-throttle steering functionality is enabled, activating the off-throttle steering functionality in response to off-throttle steering conditions being satisfied; and when the off-throttle steering functionality is disabled, preventing activation of the off-throttle steering functionality when the off-throttle steering conditions are satisfied.

Example embodiment 36: The method of example embodiment 35, including:

deeming the off-throttle steering conditions to be satisfied when an accelerator controlling an electric motor driving a jet propulsion system of the watercraft is in a non-actuated position, and a steering mechanism for steering the watercraft is at an operated position exceeding a steering angle threshold within a steering range of the steering mechanism.

Example embodiment 37: The method of example embodiment 35, wherein activating the off-throttle steering system includes: commanding an electric motor to drive a jet propulsion system to provide an off-throttle steering thrust magnitude for an off-throttle steering thrust duration.

The invention claimed is:

1. An electric watercraft comprising:

a jet propulsion system to form a water jet to provide thrust to propel the watercraft;

an electric motor to drive the jet propulsion system;

a battery system to power the motor;

an accelerator which can be actuated over an accelerator actuation range to control the motor to adjust an amount of thrust provided by the water jet;

a steering mechanism operable over a steering range to steer the watercraft; and a controller to:

receive information indicative of a speed of the watercraft; and enable an otherwise disabled off-throttle steering functionality when the speed of the watercraft exceeds a predetermined speed threshold;

when the off-throttle steering functionality is enabled, activate the off-throttle steering functionality in response to off-throttle steering conditions being satisfied; and when the off-throttle steering functionality is disabled, prevent activation of the off-throttle steering functionality when the off-throttle steering conditions are satisfied.

2. The watercraft of claim 1, wherein the off-throttle steering conditions are satisfied when:

the accelerator is in a non-actuated position; and the steering mechanism is in an operated position which exceeds a steering angle threshold of a steering range of the steering mechanism.

3. The watercraft of claim 2, wherein the accelerator is in a non-actuated position when a position of the accelerator within the accelerator actuation range does not exceed an accelerator threshold position.

4. The watercraft of claim 3, wherein the position of the accelerator within the accelerator actuation range is determined via a position sensor associated with the accelerator.

5. The watercraft of claim 2, wherein an operated position of the steering mechanism is determined via one of a position sensor associated with the steering mechanism and a gyroscope.

6. The watercraft of claim 1, wherein the off-throttle steering functionality comprises commanding the electric motor to drive the jet propulsion system to provide an off-throttle steering thrust magnitude for an off-throttle steering thrust duration.

7. The watercraft of claim 6, wherein the off-throttle steering thrust magnitude and off-throttle steering thrust duration have predetermined fixed values.

8. The watercraft of claim 6, the controller to provide a variable off-throttle steering thrust magnitude and/or variable off-throttle steering thrust duration based on one or more of the speed of the watercraft and a rate at which the steering mechanism is operated.

9. The watercraft of claim 1, including a first device to provide the information indicative of the speed of the watercraft, the first device comprising one of a GPS receiver and an accelerometer.

10. The watercraft of claim 1, wherein information indicative of a speed of the watercraft comprises information which acts as a proxy for the speed of the watercraft.

11. The watercraft of claim 10, wherein the information indicative of a speed of the watercraft is provided in the form of an energy accumulation value of an energy accumulation bank.

12. A watercraft comprising:

a jet propulsion system to form a water jet to provide thrust to propel the watercraft;

a driver unit to drive the jet propulsion system;

an accelerator which can be actuated over an accelerator actuation range to control the driver to adjust an amount of thrust provided by the water jet;

a steering mechanism operable over a steering range to steer the watercraft;

a first device to provide a first output having a value representing a first operating parameter indicative of a speed of the watercraft; and a controller to:

sample the value of the first output at a sampling rate;

dynamically adjust an energy accumulation value based on each sample value of the first output, wherein a present value of the energy accumulation value is representative of a speed of the watercraft;

enable off-throttle steering functionality of the watercraft when the energy accumulation value exceeds a threshold energy accumulation value, otherwise to disable off-throttle steering of the watercraft.

13. The watercraft of claim 12, the first device comprising a position sensor to sense a position of the accelerator within the accelerator actuation range.

14. The watercraft of claim 12, the first device comprising a speed sensor to detect a rotational speed of the electric motor.

15. The watercraft of claim 12, beginning at an initial value, for each sample of the first output, the controller to increment the energy accumulation value by a first amount when the operating speed exceeds an operating speed threshold, and to decrement the energy accumulation value by a second amount when the operating speed does not exceed the operating speed threshold.

16. The watercraft of claim 15, the first amount being greater than the second amount.

17. The watercraft of claim 15, the initial value being zero.

18. The watercraft of claim 15, the energy accumulation value having a cap value greater than the threshold energy accumulation value, the controller to not increment the energy accumulation value by the first amount when the energy accumulation value is at the cap value.

19. The watercraft of claim 12, for each sample of the first output, the controller to determine the energy accumulation value based on the sample of the first output and previous samples over a period of time.

20. The watercraft of claim 12, further including:

a second device to provide a second output having a value representing a second operating parameter indicative of a watercraft turning parameter;

when the off-throttle steering functionality is enabled, when the accelerator is operated at a position below an accelerator threshold position of the accelerator actuation range, and the second output value exceeds a threshold value of the second operating parameter, the controller to activate off-throttle steering functionality by directing the motor to drive the jet propulsion system to provide an off-throttle steering thrust magnitude for an off-throttle steering thrust duration.

21. The watercraft of claim 20, wherein the second device comprises a position sensor to sense a position of the steering mechanism within a steering mechanism range.

22. A method of operating an electric jet propulsion watercraft including:

monitoring an operating speed of the watercraft;

enabling an otherwise disabled off-throttle steering functionality when the operating speed of the watercraft exceeds a predetermined operating speed threshold;

when the off-throttle steering functionality is enabled, activating the off-throttle steering functionality in response to off-throttle steering conditions being satisfied; and when the off-throttle steering functionality is disabled, preventing activation of the off-throttle steering functionality when the off-throttle steering conditions are satisfied.

* * * * *